US011079109B2

(12) United States Patent
Muinonen et al.

(10) Patent No.: US 11,079,109 B2
(45) Date of Patent: Aug. 3, 2021

(54) CONTROL SYSTEM FOR CONTROLLING FEED OF SOLID FUEL IN A COMBUSTION PROCESS

(71) Applicant: INRAY OY, Mikkeli (FI)

(72) Inventors: Mika Muinonen, Mikkeli (FI); Janne Kovanen, Mikkeli (FI)

(73) Assignee: INRAY OY, Mikkeli (FI)

( * ) Notice: Subject to any disclaimer, the term of this patent is extended or adjusted under 35 U.S.C. 154(b) by 284 days.

(21) Appl. No.: 15/551,044

(22) PCT Filed: Feb. 18, 2016

(86) PCT No.: PCT/FI2016/050102
§ 371 (c)(1),
(2) Date: Aug. 15, 2017

(87) PCT Pub. No.: WO2016/132017
PCT Pub. Date: Aug. 25, 2016

(65) Prior Publication Data

US 2018/0010794 A1 Jan. 11, 2018

(30) Foreign Application Priority Data

Feb. 19, 2015 (FI) ..... 20155111

(51) Int. Cl.
*F23N 1/00* (2006.01)
*F23K 3/16* (2006.01)
(Continued)

(52) U.S. Cl.
CPC ..... *F23N 1/002* (2013.01); *F23G 7/10* (2013.01); *F23K 3/00* (2013.01); *F23K 3/16* (2013.01);
(Continued)

(58) Field of Classification Search
None
See application file for complete search history.

(56) References Cited

U.S. PATENT DOCUMENTS 3,270,204 A 8/1966 Rathbone
3,856,214 A * 12/1974 Kaltenbach ..... B02C 17/1805 241/34
(Continued)

FOREIGN PATENT DOCUMENTS

EP 0 344 757 12/1989
EP 0 415 582 A2 3/1991
(Continued)

OTHER PUBLICATIONS

Supplementary European Search Report and Search Opinion for Application No. EP 16 75 1974, dated Sep. 17, 2018.
(Continued)

*Primary Examiner* — Avinash A Savani
*Assistant Examiner* — Martha M Becton
(74) *Attorney, Agent, or Firm* — Nixon & Vanderhye

(57) ABSTRACT

Disclosed is a control system for controlling the feed of a solid fuel in a combustion process. The system includes a control unit which is adapted to communicate by way of a communications link in the system, to receive from online measuring instruments online measurement data regarding a fuel coming from a fuel reception unit, and to control a feeding unit for delivering the measured fuel into a fuel silo on the basis of its content model and measurement data.

12 Claims, 1 Drawing Sheet

(51) Int. Cl.
*F23G 7/10* (2006.01)
*F23K 3/00* (2006.01)
*F23N 5/18* (2006.01)

(52) U.S. Cl.
CPC ..... *F23N 5/184* (2013.01); *F23G 2205/121* (2013.01); *F23G 2205/122* (2013.01); *F23G 2205/124* (2013.01); *F23G 2205/14* (2013.01); *F23G 2207/20* (2013.01); *F23G 2209/26* (2013.01); *F23G 2900/55006* (2013.01); *F23G 2900/55011* (2013.01); *F23K 2201/501* (2013.01); *F23N 2005/185* (2013.01); *F23N 2221/10* (2020.01); *F23N 2223/08* (2020.01); *F23N 2223/40* (2020.01); *F23N 2239/02* (2020.01)

(56) References Cited

U.S. PATENT DOCUMENTS 4,270,470 A * 6/1981 Barnett ..... B03B 9/06 110/222
4,281,603 A * 8/1981 Probsteder ..... F23G 5/444 110/109
4,521,139 A 6/1985 Kretschmer et al.
4,540,129 A 9/1985 Zadiraka
4,697,530 A * 10/1987 Marcotte ..... F22B 13/00 110/101 C
4,749,122 A * 6/1988 Shriver ..... F23N 1/022 122/448.1
4,999,792 A * 3/1991 Anderson ..... F23N 1/002 431/2
5,425,316 A * 6/1995 Malone ..... F23G 5/006 110/190
5,784,974 A * 7/1998 Krauss ..... F23N 5/184 110/101 C
8,640,633 B2 2/2014 Raley et al.
8,757,071 B2 * 6/2014 Tiernan ..... F23G 7/003 110/289
8,833,276 B2 * 9/2014 Bang ..... F23G 5/16 110/257
8,979,952 B2 * 3/2015 Raiko ..... C10B 49/02 44/550
9,181,046 B2 * 11/2015 Stevenson ..... C10J 3/50
9,731,298 B2 * 8/2017 Tsutsumi ..... B02C 15/00
9,993,788 B2 * 6/2018 Wahlberg ..... B01J 3/02
10,047,408 B2 * 8/2018 Thyr ..... C12P 19/02
10,106,328 B2 * 10/2018 Detlefsen ..... B30B 9/121
10,139,166 B2 * 11/2018 Hallowell ..... F27D 19/00
10,385,506 B2 * 8/2019 Pettersson ..... B01J 8/0045
10,648,739 B2 * 5/2020 Hallowell ..... F23N 5/18
2002/0050236 A1 5/2002 Beaumont et al.
2008/0163803 A1 * 7/2008 Barker ..... F23G 5/008 110/185
2012/0318180 A1 * 12/2012 Bang ..... F23G 5/16 110/276
2013/0079922 A1 * 3/2013 Laakkonen ..... F23G 5/02 700/230
2013/0224673 A1 * 8/2013 Tiernan ..... F23G 5/20 432/105
2013/0312321 A1 11/2013 Goldberg
2014/0151191 A1 * 6/2014 Stevenson ..... C10J 3/30 198/572
2015/0081086 A1 * 3/2015 Hallowell ..... F23N 5/022 700/209
2017/0113198 A1 * 4/2017 Wahlberg ..... B01J 3/02
2017/0175209 A1 * 6/2017 Thyr ..... C12P 19/02
2017/0217687 A1 * 8/2017 Detlefsen ..... B30B 9/121
2019/0072330 A1 * 3/2019 Hallowell ..... F23N 1/042

FOREIGN PATENT DOCUMENTS

EP 2 141 414 A1 1/2010
JP 2015045463 A 3/2015
WO 2011/121187 A2 10/2011
WO 2014/0465768 A2 5/2014
WO 2014/179757 A2 11/2014

OTHER PUBLICATIONS

FI Search Report, dated Sep. 22, 2015, from corresponding FI 20155111 application.
International Search Report, dated May 12, 2016, from corresponding PCT/FI2016/050102 application.
FI Office Action, dated May 5, 2017, from corresponding FI 20155111application.
Chinese Office Action dated Jan. 22, 2021, from corresponding CN application No. 2016800111389.

* cited by examiner

CONTROL SYSTEM FOR CONTROLLING FEED OF SOLID FUEL IN A COMBUSTION PROCESS

TECHNICAL FIELD

The application relates generally to a control system for controlling the feed of a solid fuel in a combustion process.

BACKGROUND

Some of the solid fuel, e.g. peat, woodchips or sawdust, arriving at heating and power facilities for use in a combustion process, is unloaded on the field from where the fuel is loaded by a bucket loader onto a conveyor either directly or in such a way that various types of fuel are blended with visual inspection, e.g. in amongst bark is admixed dry cutter shavings.

On the other hand, some of the incoming fuel is unloaded directly into the facility's reception pockets, wherefrom it is conducted on conveyors into silos according to fuel type information inputted into the system with a truck scale by a fuel supplier or without more precise information about the type of fuel.

Alternatively, all fuels arrive at a reception station, wherefrom the fuel proceeds into storage silos or buildings. Fuel fractions are blended at reception on the basis of just type information, or the mixing is carried out in storage spaces where the fuel is unloaded into a stack and removed with transverse screws from a bottom of the stack. In a storage space, peat can be placed on one side of the storage space and all types of wood chips elsewhere, but the most common practice is place all fuel types in disarray.

SUMMARY

It is one objective of the invention to eliminate some of the problems of the prior art and to control a solid fuel combustion process in view of reducing the quality fluctuations of a solid fuel to be supplied into a boiler, thereby facilitating e.g. the regulation of a combustion process, improving the efficiency of an incineration plant, reducing operating and maintenance costs with a declining corrosion effect, as well as reducing greenhouse, CO, NOx and the like emissions.

The one objective of the invention is attained with a control system of claim 1, a control method of claim 8, a computer program of claim 9, and a computer program product of claim 10.

The control system according to one embodiment, which is intended for controlling the feed of a solid fuel in a combustion process, comprises a control unit which is adapted to communicate in the system by way of a communications link. In addition, the control unit is adapted to receive online measurement data from online measuring instruments, regarding a fuel coming from a fuel reception unit, and to control feeding equipment for delivering the measured fuel into a fuel silo on the basis of its content model and measurement data.

The term solid fuel is used e.g. in reference to biofuels to be burned in heating and/or power facilities, e.g. wood chips, e.g. whole tree chips, forest residue chips, stump chips and recycled woodchips; wood dust, e.g. sawdust and cutter swarf; bark, peat, recycled fuels, e.g. REF, RDF and SRF; wood briquettes, wood pellets, field biomasses, e.g. straw and reed canary grass; coal and side flows of pulp and paper industry.

The term communications link is used e.g. in reference to a wired and/or wireless communication connection between devices capable of data connection. The wired link can be e.g. a USB (Universal Serial Bus) link, an Ethernet connection or some other link with an ability to communicate signals via wires, fibers or other landline media. The wireless link can be e.g. a short range wireless connection, e.g. a Bluetooth, Wi-Fi, wireless USB or some other wireless connection. The communications link can be established by means of at least one of the following communication networks; Internet, extranet and intranet; a mobile communication network which uses e.g. GSM, EDGE, UMTS, CDMA or WCDMA technology; or a public switched telephone network.

The term online measurement is used e.g. in reference to continuous measuring devices which make use of X-ray, microwave, infrared and magnetic resonance technology. In addition, reference can be made e.g. to a measurement based on devices using electrical capacitance or conductance, ultrasound acoustic, laser and video imaging.

The control method according to one embodiment, which is intended for controlling the feed of a solid fuel in a combustion process, comprises using a control unit for receiving from online measuring instruments, by way of a communications link, online measurement data regarding a fuel coming from a fuel reception unit. The method further comprises controlling, by way of the communications link, feeding means for delivering the measured fuel into a fuel silo on the basis of its content model and measurement data.

The computer program according to one embodiment, which is intended for controlling the feed of a solid fuel in a combustion process as it is run on a computer, comprises a reception code which is adapted to use a control unit for receiving from online measuring instruments, by way of a communications link, online measurement data regarding a fuel coming from a fuel reception unit. The computer program further comprises a control code, which is adapted to use the control unit for controlling, by way of the communications link, feeding means for delivering the measured fuel into a fuel silo on the basis of its content model and measurement data.

The computer program product according to one embodiment, which comprises a computer program intended for controlling the feed of a solid fuel in a combustion process as it is run on a computer. The computer program comprises a reception code which is adapted to use a control unit for receiving from online measuring instruments, by way of a communications link, online measurement data regarding a fuel coming from a fuel reception unit, and a control code which is adapted to use the control unit for controlling, by way of the communications link, feeding means for delivering the measured fuel into a fuel silo on the basis of its content model and measurement data.

Other embodiments are presented in the dependent claims.

BRIEF DESCRIPTION OF THE FIGURES

In a detailed description of the figures, various embodiments of the invention will be discussed more precisely with reference to the accompanying figures, in which.

DETAILED DESCRIPTION OF THE FIGURES

Figure 1A:
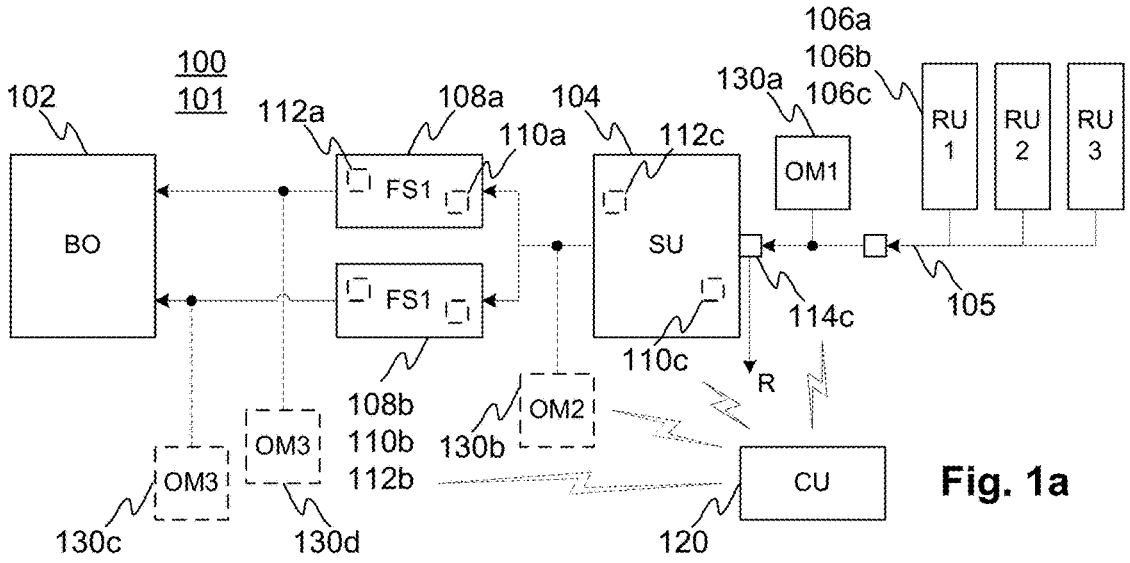
FIG. 1*a* shows a control system, wherein fuel is temporarily stored in a storage silo.

FIG. 1*a* shows a control system 100 used in an incineration plant 101 intended for the production of energy, e.g. in a heating and/or power facility, for controlling the feed of a solid fuel, e.g. a biofuel such as woodchips, in its combustion process.

The facility 101 may comprise at least one reception unit 106*a*, 106*b*, 106*c* for a fuel to be burned, which comprises e.g. at least one indoor or outdoor reception pocket, wherein fuel carrying trucks may dump their loads or wherein the fuel stored elsewhere can be loaded by bucket loaders. Pockets included in the unit 106*a*, 106*b*, 106*c* may vary in number but if peat is employed as a fuel, it can have its own pocket.

The facility 101 comprises a boiler 102 for burning fuel and producing energy.

The facility 101 may further comprise conveying means 105, e.g. belt, chain, screw, scraper, lamella or elevator (belt-chain) conveyors, vibratory feeders or stoker dischargers, for conveying fuel from the unit 106*a*, 106*b*, 106*c* towards the boiler 102 after being removed from the unit 106*a*, 106*b*, 106*c* e.g. with drag chain and/or stoker dischargers.

The facility 101 may further comprise at least one fuel silo 104, 108*a*, 108*b* between the unit 106*a*, 106*b*, 106*c* and the boiler 102. The storage silo (storage) 104 is used for the interim storage of fuel prior to its transfer into at least one feeding silo 108*a*, 108*b*. The feeding silo(s) 108*a*, 108*b* is (are) used for storage of fuel prior to its delivery into the boiler 102.

Each silo 104, 108*a*, 108*b* may comprise feeding means 110*a*, 110*b*, 110*c*, e.g. drag chain and/or belt conveyors, for supplying the silo 104, 108*a*, 108*b* with fuel arriving by way of the conveying means 105. Alternatively, the conveying means 105 may also carry out a function of the feeding means 110*a*, 110*b*, 110*c*.

Each silo 104, 108*a*, 108*b* may comprise discharging means 112*a*, 112*b*, 112*c*, e.g. a discharge screw(s), and stoker and/or drag chain bottom dischargers present on a bottom of the silo 104, 108*a*, 108*b* for conveying fuel onto the discharging screw(s) in view of discharging fuel from the silo 104, 108*a*, 108*b* onto the conveying means 105.

In addition, each silo 104, 108*a*, 108*b* may comprise separate or joint control means capable of communicating by way of a communications link to the feeding means 110*a*, 110*b*, 110*c* and to the discharging means 112,*a*, 112*b*, 112*c*.

The facility 101 may further comprise removal means 114*c*, e.g. a removal gate or a screw conveyor with a reversible discharge direction, for clearing the conveying means 105 or the combustion process of fuel which for some reason is rejected as unacceptable for the combustion process.

The facility 101 may further comprise control elements for the removal means 14*c*, which are capable of communicating by way of a communications link.

The system 100 comprises a control unit 120 which is capable of communicating in the system 100 by way of a communications link, e.g. wirelessly by way of a mobile communication network as shown in the figure.

The system 100 further comprises at least one set of online quality measuring instruments 130*a*, 130*b*, 130*c*, 130*d*, which are capable of communicating with the unit 120 by way of a communications link. Making use of the online quality measurement of fuel enables an enhancement of the facility 101 in terms of its production.

The system 100 may comprise merely the first set of measuring instruments 130*a*, e.g. X-ray measuring instruments, which are installed in connection with the conveying means 105 between the unit 106*a*, 106*b*, 106*c* and the silo 104.

The measuring instruments 130*a* can be installed as shown in the figure, or by having the same installed in connection with each of the designated conveyor means 105 coming from each pocket of the unit 106*a*, 106*b*, 106*c*.

The measuring instruments 130*a* monitor the fuel (a batch of fuel) carried on the conveying means 105 by continuous measuring and supply the unit 120 with fuel-related measurement data obtained from the measurement.

The unit 120 receives measurement data from the measuring instruments 130*a* and is able to continuously calculate from the measurement data at least one of the fuel quality criteria (quality data): type of fuel, moisture content, foreign matter content, ash content, at least one element concentration, energy content, density, mass, and fragment size.

In addition, the unit 120 may control the removal means 114*c* by way of a communications link for removing the fuel measured with the measuring instruments 130*a*, on the basis of the received measurement data and the at least one calculated criterion thereof, from the conveying means 105 prior to feeding it into the silo 104.

The unit 120 is additionally able to establish a real-time content model for the silo 104, e.g. two- or three-dimensional model, about its fuel distribution on the basis of at least one of the aforesaid criteria, e.g. the energy content, to maintain the established content model and to update it in real time according to fuel being supplied and discharged.

In the content model, it is possible to utilize not only the at least one criterion but also e.g. at least one of the following data: operating data for the conveyor means 105, identification data for fuel loads, e.g. information about a supplier, a type and/or a location, information about a truck scale used for determining the amount of a fuel load and other possible information obtainable from auxiliary measurements, e.g. operating data for a belt scale and/or other equipment.

The unit 120 may further control feeding means 110*c* of the silo 104 by way of a communications link for feeding the measured fuel from the conveying means 105 into the silo 104. Based on the content model and the measurement data received from the measuring instruments 130*a*, the feeding means 110*c* are supplied with control information regarding to which part of the silo 104 the fuel is to be delivered.

In addition, the unit 120 may control discharging means 112*c* by way of a communications link for discharging fuel onto the conveying means 105 extending from the silo 104 to the silo 108*a*, 108*b*. Based on the content model and the possibly received measurement data, the discharging means 112*c* are supplied with control information regarding from which part of the silo 104 the fuel is to be discharged onto the conveying means 105.

Moreover, the unit 120 is able to receive information about upcoming fuel loads, e.g. information about suppliers, fuel type, place of delivery, and scale data.

The system 100 may comprise second measuring instruments 130*b*, e.g. X-ray measuring instruments, which are installed in connection with the conveying means 105 between the silo 104 and the silo 108*a*, 108*b*.

The unit 120 may receive measurement data from the measuring instruments 130*b* and it may calculate continuously from the discussed measurement data at least one of the aforesaid criteria, e.g. the energy content.

In addition, the unit 120 is able to establish a real-time content model for each silo 108*a*, 108*b*, e.g. a two- or three-dimensional model, about its fuel distribution on the basis of the at least one aforesaid criterion, to maintain the established content model and to update it in real time according to fuel being supplied and discharged.

The unit 120 may further control the feeding means 110*a*, 110*b* for the silo 108*a*, 108*b* by way of a communications link for feeding fuel into the silo 108*a*, 108*b*. Based on the content model and the measurement data received from the measuring instruments 130*b*, the conveying means 105 are supplied with control information regarding into which silo 108*a*, 108*b* the fuel to be conveyed and the feeding means 110*a*, 110*b* are supplied with control information regarding to which part of the silo 108*a*, 108*b* the fuel is to be delivered.

In addition, the unit 120 may control the discharging means 112*a*, 112*b* of the silo 108*a*, 108*b* by way of a communications link for discharging fuel onto the conveying means 105 extending from the silo 108*a*, 108*b* to the boiler 102. Based on the content model and based on measurement data possibly received from the measuring instruments 130*b*, the discharging means 112*a*, 112*b* are supplied with control information regarding from which part of the silo 108*a*, 108*b* the fuel is to be discharged onto the conveying means 105.

Controlling the feeding and discharging means 110*a*, 110*b*, 110*c*, 112,*a*, 112*b*, 112*c* of each silo 104, 108*a*, 108*b* enables an improvement in the quality of a fuel passing into the boiler 102, i.e. an effort to provide a fuel with quality as consistent as possible, whereby it is optimal from the standpoint of a combustion process.

Also, the control enables an optimization of fuel mixtures. The optimization of mixture ratios is a way of avoiding the feeding of expensive additives, e.g. elemental sulfur and sulfates, into the boiler 102 in case there is a risk of chlorine-induced corrosion.

In addition, the control enables a protection of the boiler 102 by avoiding undesired fuel blends which increase the corrosion risk.

The control further provides an ability to maintain the boiler 102 and a turbine in optimal operation (boiler-turbine balance), to reduce emissions and to improve the efficiency of a combustion process.

By virtue of its online measurement, the system 100 is capable of supplying and controlling the supply of fuel.

In addition, the unit 120 is able to transmit, by way of a communications link, fuel demand information based on a content model of the silo 104 and/or the silo 108*a*, 108*b* to a unit in charge of the supply of fuel, e.g. to at least one supply program of the unit 120 or some other computer. The demand information makes it possible to report which fuel fractions are needed in the facility 101 for maintaining an optimal fuel distribution.

The unit 120 may further receive predictions from fuel supply programs regarding upcoming fuel loads, thereby enabling the establishment of demand data also on the basis of e.g. predictions and a content model.

The system 100 may comprise third measuring instruments 130*c*, 130*d*, e.g. X-ray measuring instruments, which are installed in connection with the conveying means 105 between each silo 108*a*, 108*b* and the boiler 102.

In addition, the system 100 may comprise control means, which control the combustion process of the boiler 102 and which are capable of communicating by way of a communications link.

The unit 120 is able to receive measurement data from the measuring instruments 130*c*, 130*d* and is able to calculate continuously from the discussed measurement data at least one of the aforesaid criteria, e.g. the energy content.

In addition, the unit 120 is able to transmit information pertinent to measurement data received from the measuring instruments 130*c*, 130*d*, e.g. measurement data or information about a calculated criterion, to the control means of the combustion process of the boiler 102.

Figure 1B:
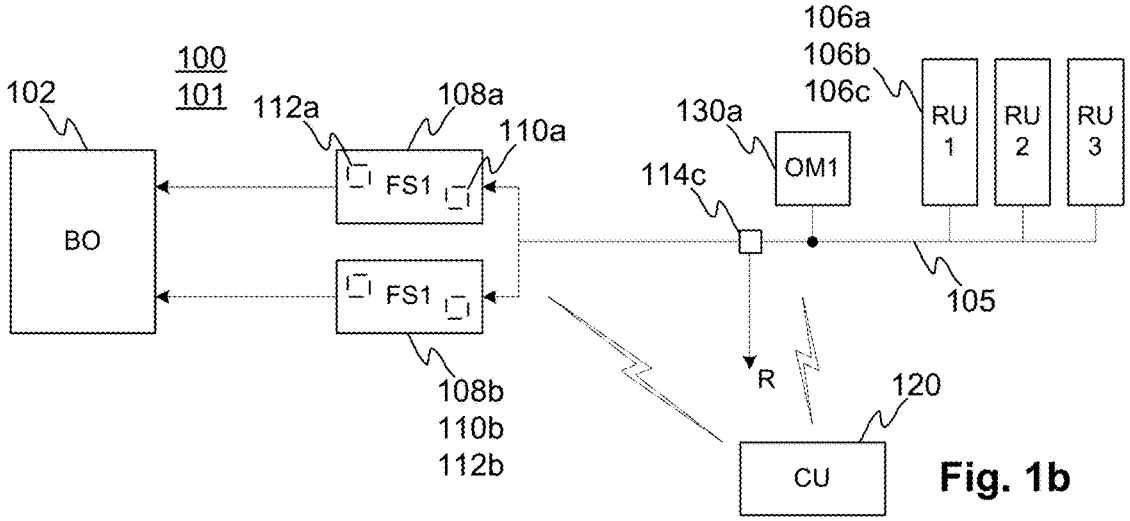
FIG. 1*b* shows a control system, wherein fuel is conveyed from a reception unit directly into feeding silos.

FIG. 1*b* shows a facility 101 similar to that of FIG. 1*a*, but missing the silo 104 serving as an intermediate storage.

The system 100 only comprises measuring instruments 130*a*, e.g. X-ray measuring instruments, which are installed in connection with the conveying means 105 between the unit 106*a*, 106*b*, 106*c* and the silo 108*a*, 108*b*.

The measuring instruments 130*a* measure continuously a fuel carried on the conveying means 105 and supply the unit 120 with fuel-related measurement data obtained from the measurement.

The unit 120 receives measurement data from the measuring instruments 130*a* and is able to calculate continuously from the discussed measurement data at least one the aforesaid criteria, e.g. the energy content.

The unit 120 is able to control the discharge means 114*c*, to establish a content model about its fuel distribution on the basis of at least one of the aforesaid criteria, e.g. the energy content, to maintain and update the established content model as in the system 100 of FIG. 1.

In addition, the unit 120 is able to control feeding means 110*a*, 110*b* and discharging means 112*a*, 112*b* for the silo 108*a*, 108*b* as in the system 100 of FIG. 1.

The unit 120 is further able to transmit fuel demand information based on a content model of the silo 108*a*, 108*b* as in the system 100 of FIG. 1.

By virtue of its online measurement, the system 100 is capable of controlling the supply of fuel for the facility 101.

The system 100 is easy to install in old facilities 101, its operation is not restricted by fuel employed in the facility 101, and it is not bound up with the employed measuring method.

By virtue of the system 100, the facility 101 has accurate initial data about the quality of fuel, thus enabling to make an optimal fuel mixture of consistent quality. The quality fluctuations of fuel, regarding e.g. moisture, complicate adjustment of the boiler 102, whereby the bed temperatures fluctuate with resulting emission spikes, the efficiency suffers, and the corrosion risk increases.

By virtue of the system, it is further possible to obviate production losses e.g. in winters when the entire production capacity of the facility 101 is needed.

Figure 2:
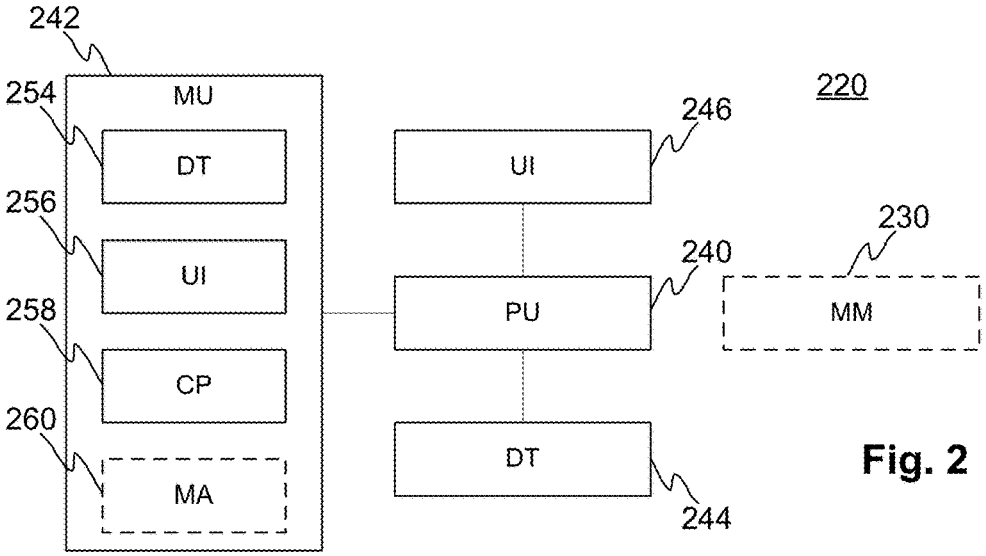

FIG. 2 shows functional units 240, 242, 244, 246 for a control unit (control device) 220 that may comprise at least one computer.

The unit 220 may comprise a processor unit 240, which comprises at least one processor and which enables the execution of instructions, defined e.g. by a user or some application program, and the processing of data.

In addition, the unit 220 may comprise a memory unit 242, which comprises at least one memory, for storing and saving data, e.g. instructions and application programs.

In addition, the unit 220 may comprise a data transfer unit 244 by means of which the unit 220 transmits and receives information by way of at least one wired and/or wireless communications link, and a user interface unit 246 by means of which the user is able to input commands and information to the unit 220 and/or to receive information from the unit 220.

The user interface unit 246 may comprise at least one of the following: a keyboard, functional keys, a display, a touchpad, a touch screen, and a microphone/speaker unit.

The memory unit 242 may comprise an application 254 controlling operation of the data transfer unit 244, an application 256 controlling operation of the user interface unit 246, and an application (computer program) 258 intended for controlling operation of the unit 220.

In addition, the memory unit 242 may comprise an application 260 controlling operation of the online quality measuring instruments 230 in the event that the measuring instruments 230 are remote-controlled from the unit 220.

The application 258 controls operations of the unit 220 and possibly other equipment 102, 104, 108*a*, 108*b*, 230 in the feed of a solid fuel in a combustion process when it is carried out in the unit 220. The application 258 comprises a reception code which uses the data transfer unit 244 to receive from the measuring instruments 230, by way of a communications link, online measurement data regarding a fuel coming in from the fuel unit 106*a*, 106*b*, 106*c*, and a control code which uses the data transfer unit 244 to control, by way of a communications link, the feeding means 110*a*, 110*b*, 110*c* for delivering the measured fuel into the silo 104, 108*a*, 108*b* on the basis of its content model and measurement data.

The application 258 can be stored not only in the memory unit 242 of the unit 220 but also in a computer program product, which is a computer-readable data transfer medium, e.g. a CD disc or a USB flash drive, and which comprises a computer program code intended to be run on a computer.

The memory unit 242 and the application 258, jointly with the processor unit 240, enable the unit 220 at least to receive with the data transfer unit 240 from the measuring instruments 230, by way of a communications link, measurement data regarding a fuel coming from the fuel unit 106*a*, 106*b*, 106*c* and to control with the data transfer unit 240, by way of a communications link, the feeding means 110*a*, 110*b*, 110*c* for delivering the measured fuel into the silo 104, 108*a*, 108*b* on the basis of its content model and measurement data.

In addition, the memory unit 242 and the application 258, jointly with the processor unit 220, enable the unit 220 to execute other functions of the unit 220 presented in connection with FIGS. 1*a* and 1*b*.

Described above are just a few embodiments of the invention. The principle according to the invention can naturally be varied within the scope protection defined in the claims, regarding for example implementation details as well as fields of use.

The invention claimed is:

1. A control system for controlling a feed of a solid biofuel in a combustion process, said control system comprising:
- a control unit;
- a fuel reception unit;
- a fuel silo for fuel storage;
- silo feeding means;
- silo discharging means; and
- online measuring instruments installed between the fuel reception unit and the fuel silo,
- wherein the control unit is configured
  - to communicate by way of a communications link in the system,
  - to receive, from the online measuring instruments, online measurement data regarding fuel coming from the fuel reception unit,
  - to calculate, continuously from the received measurement data, at least one criterion of the fuel, and
  - to establish a content model of a fuel distribution in the fuel silo based on the at least one criterion,
- wherein said content model of the fuel distribution establishes, in at least two dimensions, how the fuel is distributed in the fuel silo, and
- wherein the control unit is configured to inform
  - the silo feeding means, based on said content model of the fuel distribution and the received measurement data, regarding to which part of the fuel silo the measured fuel is delivered, and
  - the silo discharging means, based on said content model of the fuel distribution, regarding from which part of the fuel silo stored fuel is discharged.

2. The system according to claim 1, wherein the control system transmits fuel demand information based on the content model.

3. The system according to claim 2, wherein the measuring instruments are installed in connection with a conveying means between the reception unit and the fuel silo, and the control unit controls the discharging means for removing the measured fuel from the conveying means prior to delivery into the fuel silo based on measurement data received from the measuring instruments, said fuel silo being any of a storage silo and at least one feeding silo.

4. The system according to claim 2, further comprising:
- second measuring instruments installed in connection with a conveying means between a storage silo and at least one feeding silo,
- wherein the control unit controls the silo feeding means for at least one feeding silo for the delivery of fuel based on the content model and measurement data received from the second measuring instruments.

5. The system according to claim 1, wherein the measuring instruments are installed in connection with a conveying means between the reception unit and the fuel silo, and the control unit controls the discharging means for removing the measured fuel from the conveying means prior to delivery into the fuel silo based on measurement data received from the measuring instruments, said fuel silo being any of a storage silo and at least one feeding silo.

6. The system according to claim 5, further comprising:
- second measuring instruments installed in connection with a conveying means between a storage silo and at least one feeding silo,
- wherein the control unit controls the silo feeding means for at least one feeding silo for the delivery of fuel based on the content model and measurement data received from the second measuring instruments.

7. The system according to claim 1, further comprising:
- second measuring instruments installed in connection with a conveying means between a storage silo and at least one feeding silo,
- wherein the control unit controls the silo feeding means for at least one feeding silo for the delivery of fuel based on the content model and measurement data received from the second measuring instruments.

8. The system according to claim 1, further comprising:
- third measuring instruments, which are installed in connection with a conveying means between at least one feeding silo and a fuel boiler,
- wherein the control unit supplies a control means of the fuel boiler with information pertinent to measurement data received from the third measuring instruments.

9. A control method for controlling a feed of a solid biofuel in a combustion process in the system according to claim 1, said method comprising steps of:
- receiving, with a control unit, by way of a communications link, from online measuring instruments installed between a fuel reception unit and a fuel silo for fuel storage, online measurement data regarding fuel coming from a fuel reception unit;

calculating continuously with the control unit, from the received measurement data at least one criterion of the fuel;

establishing with the control unit a two-dimensional content model of a fuel distribution in the fuel silo based on the at least one criterion, said content model of the fuel distribution establishing, in at least two dimensions, how the fuel is distributed in the fuel silo;

informing, with the control unit and by way of the communications link, a silo feeding means, based on said content model of the fuel distribution and the received measurement data, regarding to which part of the fuel silo the measured fuel is delivered, and informing, with the control unit and by way of the communications link, a silo discharging means, based on said content model of the fuel distribution and the received measurement data, regarding from which part of the fuel silo stored fuel is discharged.

10. A control unit for controlling a feed of a solid biofuel in a combustion process, comprising:

a data transfer unit that receives by way of a communications link, from online measuring instruments installed between a fuel reception unit and a fuel silo for fuel storage, online measurement data regarding fuel coming from the fuel reception unit; and a processor unit configured to continuously calculate, from the measurement data, at least one criterion of the fuel, the processor unit further configured to establish a two-dimensional content model that establishes, in at least two dimensions, how the fuel is distributed in the fuel silo based on the at least one criterion, the data transfer unit configured to inform, based on said content model and the received online measurement data, and by way of the communications link, a silo feeding means regarding to which part of the fuel silo the measured fuel is delivered, and the data transfer unit further configured to inform, based on said content model and by way of the communications link, a silo discharging means regarding from which part of the fuel silo stored fuel is discharged.

11. A control method for controlling a feed of a solid biofuel in a combustion process, comprising:

receiving, from online measuring instruments installed between a fuel reception unit and a fuel silo for fuel storage, via a data transfer unit of a control unit and by way of a communications link, online measurement data regarding fuel coming from the fuel reception unit;

continuously calculating from the measurement data, by way of a processor unit of the control unit, at least one criterion of the fuel;

establishing, via the processor unit, a two-dimensional content model that establishes, in at least two dimensions, how the fuel is distributed in the fuel silo based on the at least one criterion;

informing, based on said content model and the received online measurement data, via the data transfer unit and by way of the communications link, a silo feeding means regarding to which part of the fuel silo the measured fuel is delivered; and informing, based on said content model, and via the data transfer unit and by way of the communications link, a silo discharging means regarding from which part of the fuel silo stored fuel is discharged.

12. A computer program for controlling a feed of a solid biofuel in a combustion process, said computer program recorded on a non-transitory computer-readable recording medium, said computer program, upon execution by the computer, causing the computer to:

receive, by way of a communications link, from online measuring instruments installed between a fuel reception unit and a fuel silo for fuel storage, online measurement data regarding fuel coming from the fuel reception unit;

continuously calculate, from the measurement data, at least one criterion of the fuel;

establish a two-dimensional content model that establishes, in at least two dimensions, how the fuel is distributed in the fuel silo based on the at least one criterion;

inform, based on said content model and the received online measurement data, and by way of the communications link, a silo feeding means regarding to which part of the fuel silo the measured fuel is delivered; and inform, based on said content model and by way of the communications link, a silo discharging means regarding from which part of the fuel silo stored fuel is discharged.

* * * * *